US006832394B1

(12) United States Patent
Chiang

(10) Patent No.: US 6,832,394 B1
(45) Date of Patent: Dec. 21, 2004

(54) SWIMMING GOGGLES

(76) Inventor: Herman Chiang, 11F-2, No. 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 10/813,033

(22) Filed: Mar. 31, 2004

(51) Int. Cl.[7] ..... A61F 9/02
(52) U.S. Cl. ..... 2/428; 2/452; 24/170
(58) Field of Search ..... 2/428, 430, 452, 2/440, 426; 24/170, 191, 196

(56) References Cited

U.S. PATENT DOCUMENTS 6,691,377 B2 * 2/2004 Pan ..... 24/170
6,691,378 B1 * 2/2004 Chou ..... 24/170

* cited by examiner

*Primary Examiner*—Peter Nerbun
(74) *Attorney, Agent, or Firm*—Troxell Law Office PLLC

(57) ABSTRACT

Swimming goggles has a left frame and a right frame, a nose support connecting the left frame and the right frame together, eyeglasses received respectively in the left frame and the right frame, and a head strap movably received in outward sides of the left frame and the right frame. Engaging blocks are respectively formed on outward sides of the left frame and the right frame. Each engaging block defines a receiving hole through a center thereof and forming a tongue at a lower portion thereof. Adjusting apparatus are received in the receiving holes for adjusting the head strap. Each adjusting apparatus includes a base, a cover assembled with the base for enveloping the engaging block, and a fixing axis mounted on the base and the cover. An axis hole is defined in the base for pivotably receiving the fixing axis. The fixing axis forms a pressure arm substantially on a side thereof for pressuring the tongue, and a stop arm on the other side thereof for engaging with stop slots of the head strap. A resilient button is formed on the cover for pressing the pressure arm. The pressure arms, the stop arms and the resilient buttons are cooperated to control movement of the head strap. Thus, a user can easily adjust the head strap.

14 Claims, 6 Drawing Sheets

SWIMMING GOGGLES

BACKGROUND OF THE INVENTION

1. Field of the Invention

The present invention relates to swimming goggles, and particularly to swimming goggles which have an easily-adjustable head strap and are conveniently used.

2. Related Art

Conventional swimming goggles usually consist of a left frame, a right frame, a nose support and a head strap. The head strap has adjusting fastener for positioning and adjusting the head strap. Each adjusting fastener of the conventional swimming goggles defines a pair of holes through which the head strap are pulled for adjusting. In use the head strap cannot be adjusted, and the swimming goggles have to be taken down for adjusting the head strap. So it is rather inconvenient to adjust a head strap of conventional swimming goggles in use. Moreover, the head strap is usually adjusted by users' feeling. Thus, the head strap is uneasily adjusted to a desired position in such an adjusting way, whereby it is very troublesome to adjust head strap.

SUMMARY OF THE INVENTION

Accordingly, an object of the present invention is to provide swimming goggles which are adjusted and positioned easily even if not taken it off during the adjustment and are inching-adjustable.

The swimming goggles comprise a left frame and a right frame connected together. Engaging blocks are respectively formed on outward sides of the left frame and the right frame. Each engaging block defines at least a receiving hole through a center thereof and forming a tongue at a lower portion thereof. Adjusting apparatuses are assembled to the engaging blocks for adjusting head strap. Each adjusting apparatus includes a base, a cover which is assembled with the bases for enveloping the engaging blocks and a fixing axis mounted on the base and the cover. The base has a first base wall, and a second base wall and a third base wall substantially perpendicularly depending from opposite edges of the first base wall, and defines a fastener holes therein for movably receiving the head strap. An axis hole is defined through the second base wall and the third base wall for pivotably receiving the fixing axis. The fixing axis forms pressure arm substantially on a side thereof for pressure the tongue, and a stop arm on the other side thereof for engaging with stop slots of the head strap. The cover forms a resilient button thereon for abutting the pressuring arm. A first assembling post and a second assembling post is respectively formed on an inner of the first base wall and a first cover wall of the cover and adjacent to an edge thereof for engaging with the receiving hole from on the opposite side.

When the swimming goggles are assembled the pressure arm presses the tongue to move downwardly and has reserved energy therein, and makes the stop arms engaging with a stopping slots of the head strap such that the head strap are allowed to move in a single direction. When the resilient button is pressed, the pressure arm is also moved downwardly and presses the tongue moving more downwardly so that the tongue has more reserved energy, meanwhile, the stop arm moves away from the stop slot of the head strap, such that the head strap is allowed to move in both directions and making the head strap adjustable. Notably, when the resilient button is free, the tongue with partial reserved energy drives the pressure arm to return, so the pressure arm abuts the stop slot of the head strap again. Thus, a user can easily adjust the head strap by operation of the resilient buttons.

Each base defines at least a groove in an inward side thereof, and each cover forms at least a latch at an inward side thereof for latching with the grooves, thereby reliably retaining the base and the cover.

DESCRIPTION OF THE PREFERRED EMBODIMENTS

Figure 1:
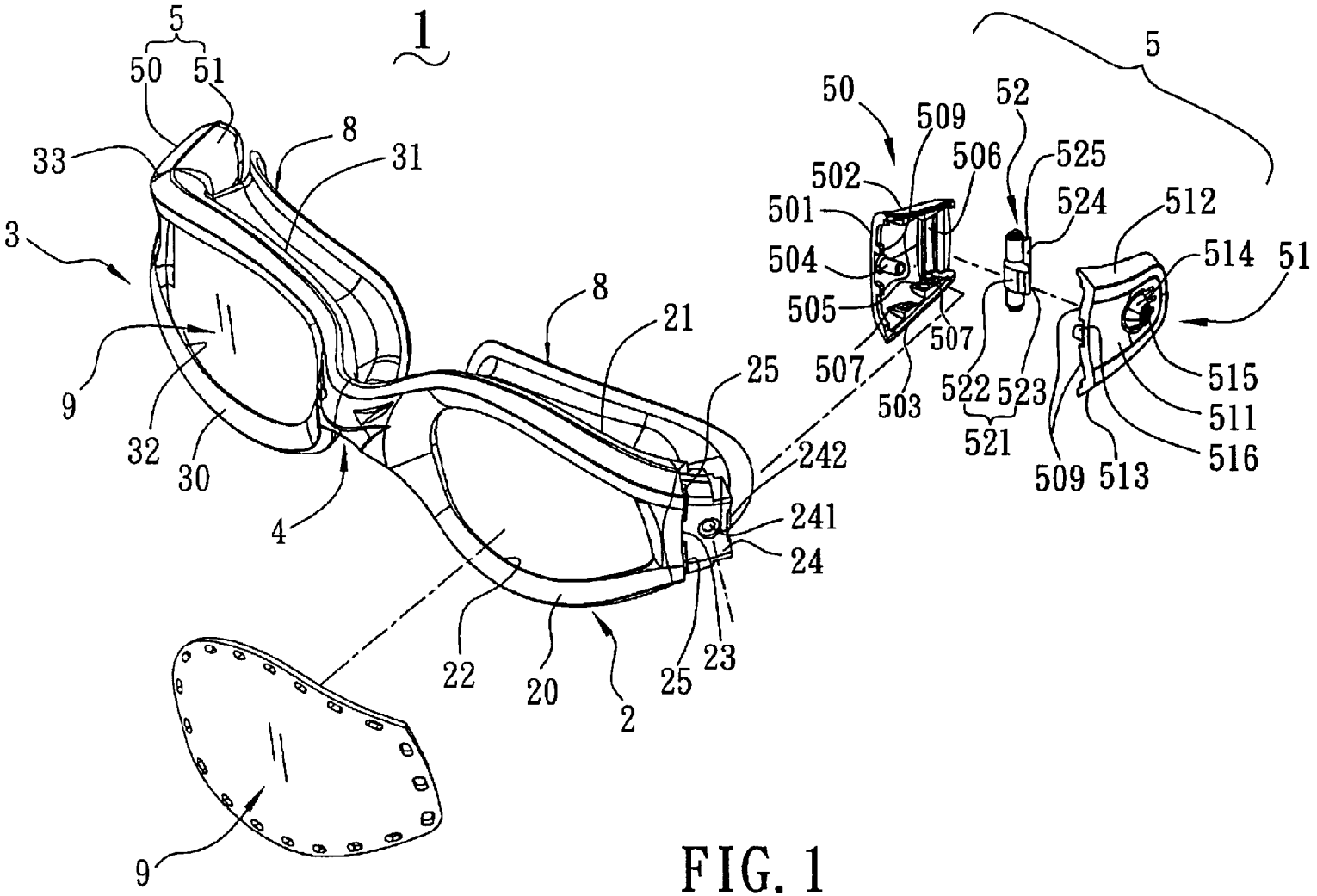
FIG. 1 is a perspective view of swimming goggles of the present invention, wherein a left frame of the swimming goggles is exploded.
Figure 2:
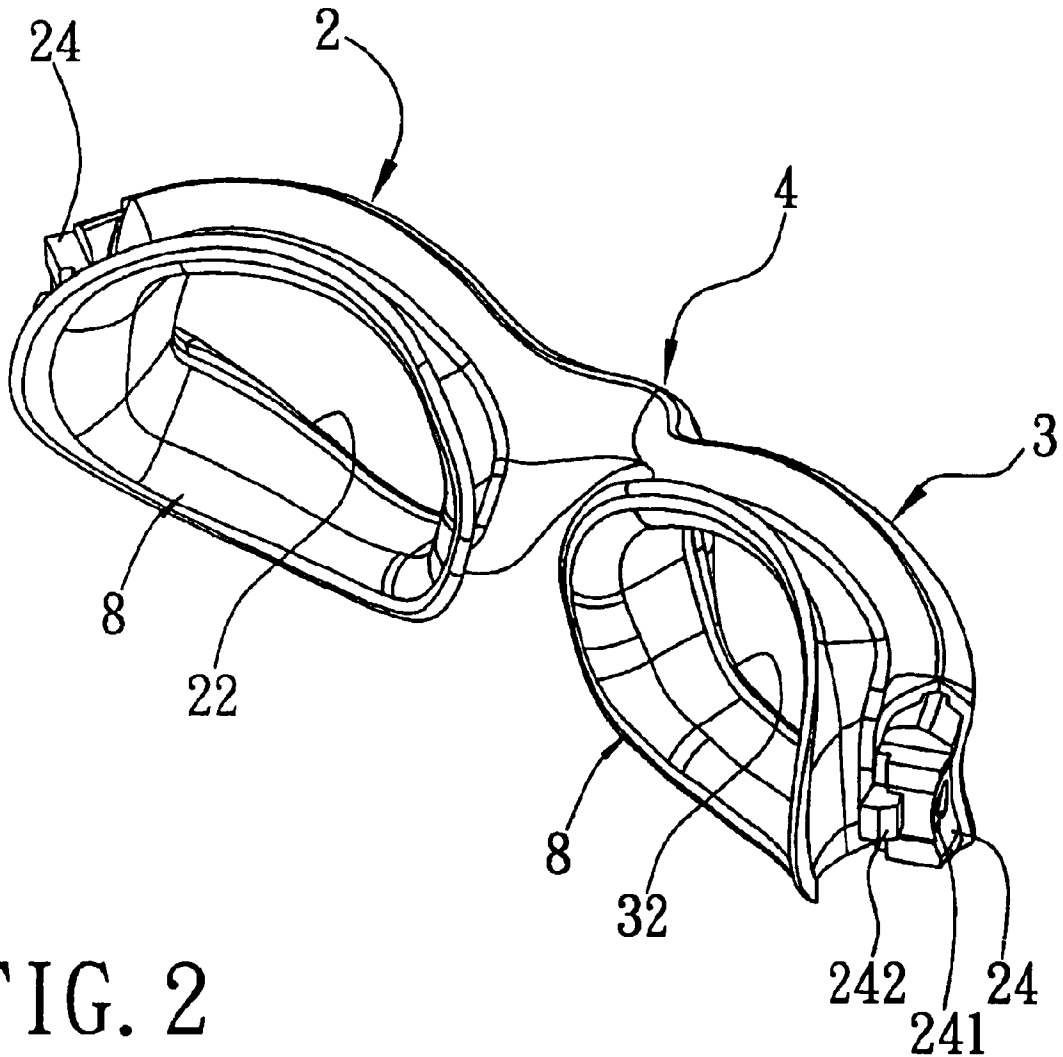
FIG. 2 is a perspective view of the swimming goggles of FIG. 1 from another aspect.
Figure 7:
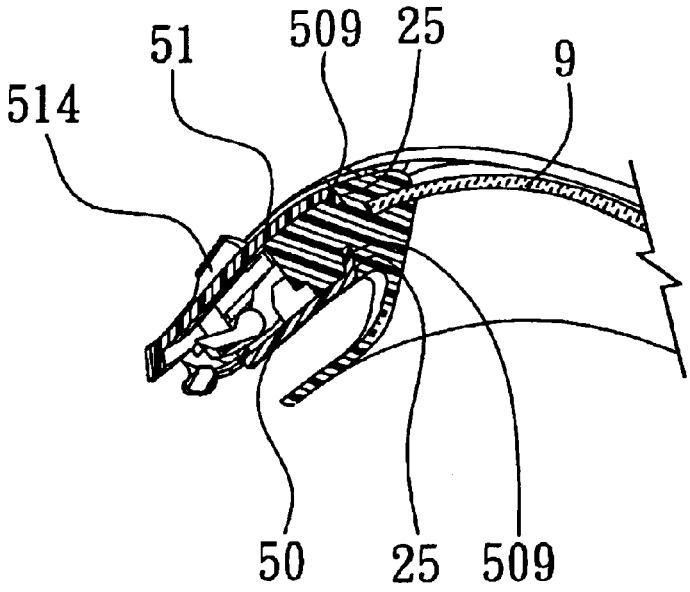
FIG. 7 is a cross-sectional view taken along the line 7—7 in FIG. 2.
Figure 8:
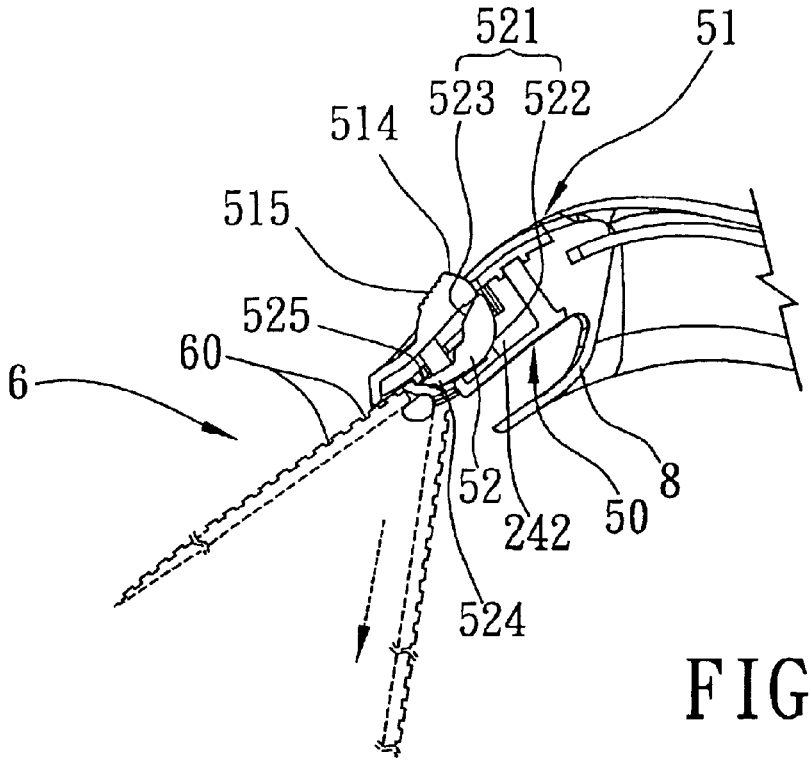
FIGS. 8 and 9 are schematic views for showing movement of head strap of the swimming goggles.
Figure 9:
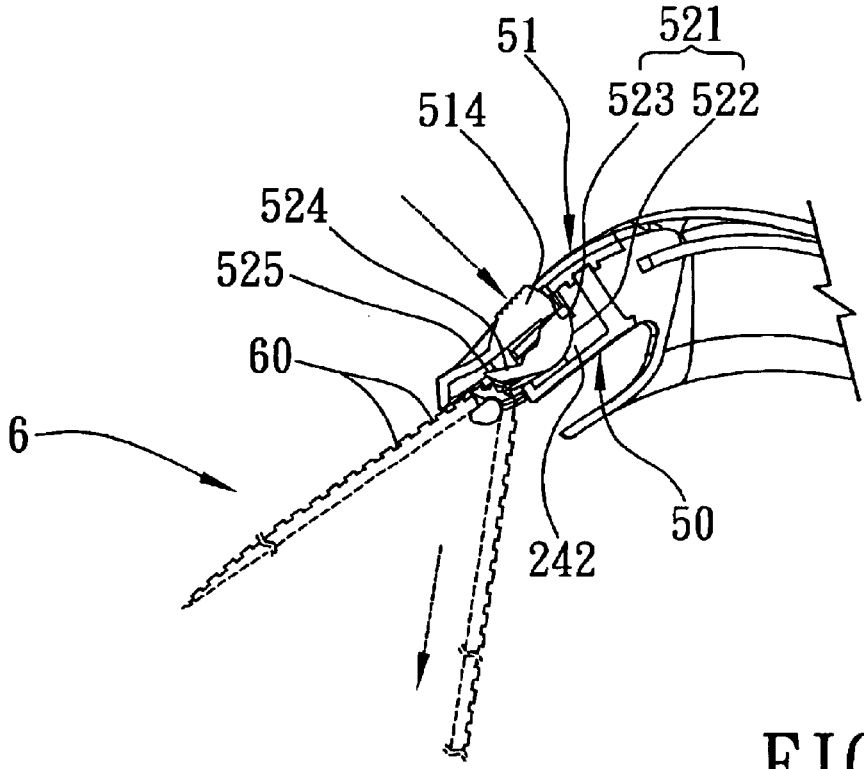

With reference to FIG. 1, swimming goggles 1 of the present invention comprise a left frame 2, a right frame 3, a nose support 4, adjusting apparatuses 5 and head strap 6 (shown in FIGS. 8 and 9). The nose support 4 is integrated with the left frame 2 and the right frame 3 and connects the left frame 2 with the right frame 3. The left frame 2 and the right frame 3 respectively have outer surfaces 20, 30 and inner surfaces 21, 31. Receiving passages 22, 32 are respectively defined between the outer surfaces 20, 30 and the inner surfaces 21, 31 for accommodating eyeglasses 9. Soft pads 8 are unitarily formed with the inner surfaces 20, 30 of the left and the right frames 2, 3 to provide comfortable touch for a user. Engaging surfaces 23, 33 are respectively formed on outward sides of the left frame 2 and the right frame 3. A solid engaging block 24 unitarily and outwardly extends from a part of each of the engaging surfaces 23, 33. Each engaging block 24 defines a receiving hole 241 substantially through a center thereof for receiving a corresponding adjusting apparatus 5. In combination with FIG. 2, each engaging block 24 has a tongue 242 extending from a lower portion thereof for returning the adjusting apparatus 5. In combination with FIG. 7, each engaging block 24 further defines four L-shaped grooves 25 at corners adjacent to the engaging surfaces 23, 33.

Figure 6:
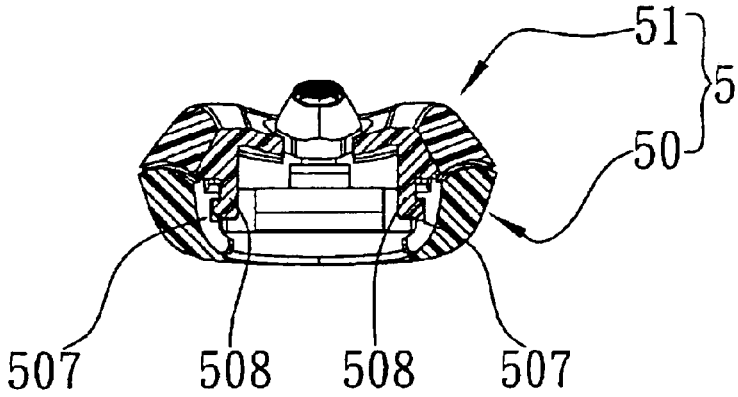
FIG. 6 is a cross-sectional view taken along the line 6—6 in FIG. 4.

Each adjusting apparatus 5 comprises a base 50, a cover 51 and a fixing axis 52. The base 50 has a first base wall 501, and a second base wall 502 and a third base wall 503 substantially perpendicularly depending from opposite edges of the first base wall 501. A first assembling post 504 is formed on an inner of the first base wall 501 and adjacent to an edge thereof for engaging with the receiving hole 241. An axis hole 505 is defined through the second base wall 502 and the third base wall 503 for receiving the fixing axis 52. Fastener holes 506 are defined in the first base wall 501 for movably receiving the head strap 6. The cover 51 has a first cover wall 511, and a second cover wall 512 and a third cover wall 513 substantially perpendicularly depending from opposite edges of the first cover wall 511. A second assembling post 516 is formed on an inner side of the first cover wall 511 and adjacent to an edge thereof for engaging with the receiving bole 241 on the other side. A resilient button 514 is integrally formed with and projects outwardly from the first cover wall 511. A plurality of inclined projections 515 is formed on an outward surface of the resilient button 514 for enhancing friction. A pressure arm 521 is transversely formed on substantially a side of the fixing axis 52. The pressure arm 521 has an arcuate side 522 for pressure the tongue 242 (referring to FIG. 8), and a flat side 523 for abutting the resilient button 514. A stop arm 524 is formed on the other side of the fixing axis 52 and has an inclined end 525 for abutting a stop slot 60 of a head strap 6 (shown in FIG. 8). With reference to FIGS. 6 and 7, in assembly, the cover 51 is assembled with the base 50 to envelop the engaging block 24. The second base wall 502 and the third base wall 503 respectively define grooves 507 in inward sides thereof. The second cover wall 512 and the third cover wall 513 respectively form latches 508 at inward sides thereof for latching with the grooves 507. L-shaped locking ribs 509 are formed respectively on the base 50 and the cover 51 and are corresponding to the L-shaped grooves 25 of the engaging blocks 24 for further retaining the base 50 and the cover 51 together.

Figure 3:
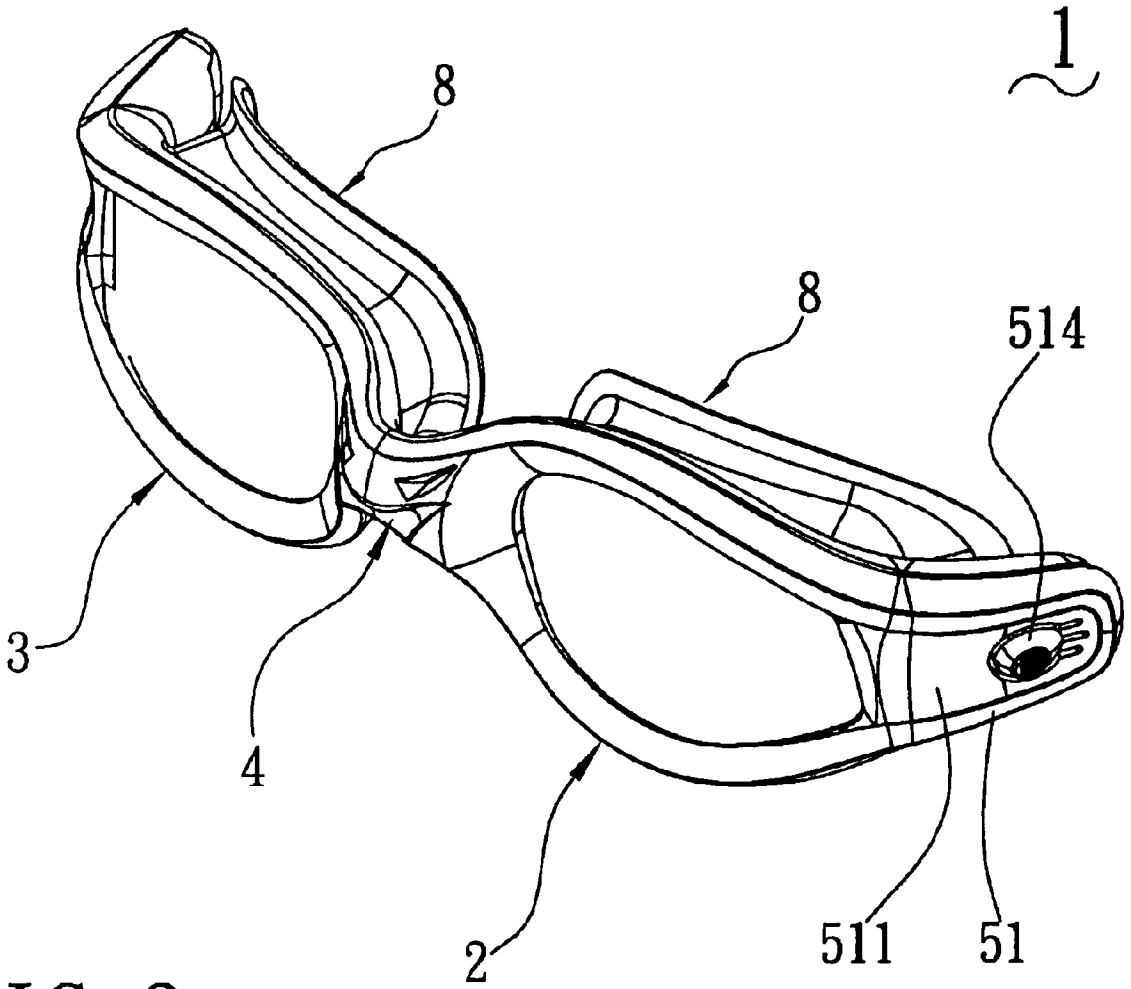
FIG. 3 is an assembled view of the swimming goggles of FIG. 1.
Figure 4:
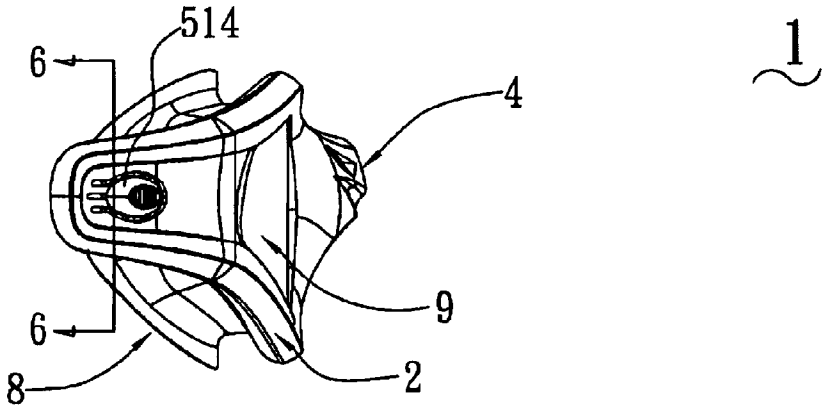
FIG. 4 is a right-side view of the swimming goggles of FIG. 3.
Figure 5:
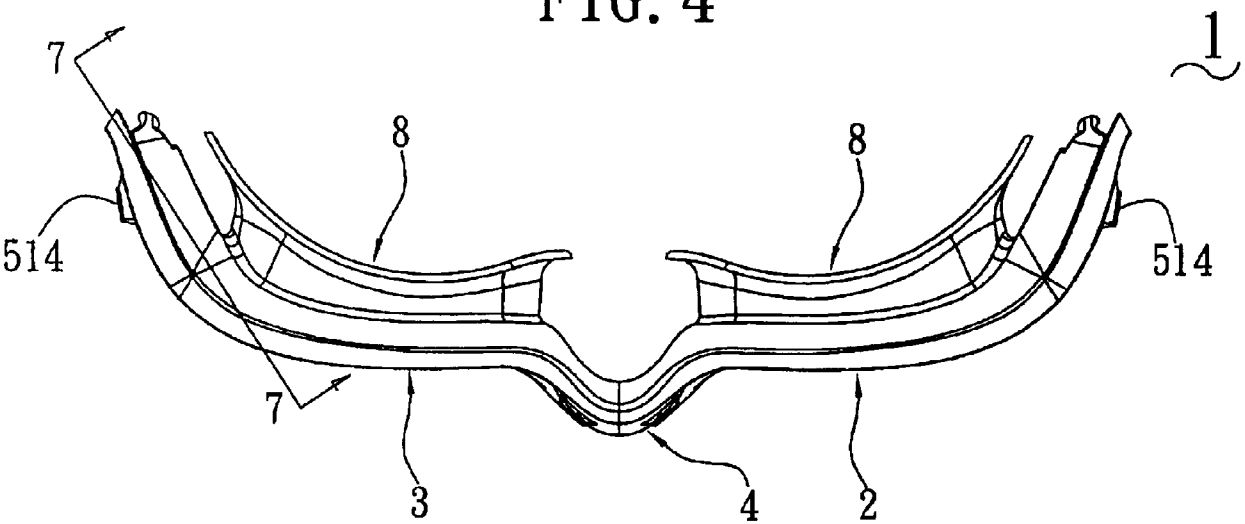
FIG. 5 is a top view of the swimming goggles of FIG. 3.

With reference to FIGS. 3–5, in assembly, the adjusting apparatuses 5 are respectively assembled on outward sides of the left frame 2 and the right frame 3. The resilient buttons 514 of the adjusting apparatuses 5 project slightly beyond the first cover wall 511 of the cover 51. Referring to FIGS. 1 and 8, the fixing axis 52 is pivotably received in the axis hole 505. The pressure arm 521 abuts against the tongue 242 such that the tongue 241 has reserved energy to return the pressure arm 521. The stop arm 524 is pushed to engage the stop slot 60 of the head strap 6, allowing the head strap 6 only to move outwardly. Thus, when a user pulls the head strap 6 outwardly, the stop arm 524 moves away from the stop slot 60 of the head strap 6, and the inclined end 525 of the stop arm 524 disengages from the stop slot 60. When a user pulls the head strap 6 slantwise (as broken line shown in FIG. 8), the stop arm 524 moves toward the stop slot 60 of the head strap 6, and the inclined end 525 of the stop arm 524 engages with the stop slot 60. Therefore, in use, the head strap 6 can be adjusted by the user's simple operation rather than taking down the swimming goggles. Referring to FIG. 9, the resilient button 514 is pressed, and the stop arm 524 moves away from the stop slot 60 of the head strap 6, making the head strap 6 adjustable. Notably, when the resilient button 514 is pressed, the flat side 522 of the pressure arm 521 is pressed. The arcuate side 523 presses the tongue 242 to move downwardly so that the tongue 242 has more reserved energy. When the resilient button 514 is free, the tongue 242 with partial reserved energy drives the pressure arm 524 to return, so the pressure arm 524 abuts the stop slot 60 again.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a left frame and a right frame connected together by a nose support, the left and the right frames respectively having an outer surface and an inner surface, receiving passages being defined between the outer surfaces and inner surfaces of the left and the right frames for accommodating eyeglasses, engaging blocks being respectively formed on outward sides of the left frame and the right frame, each engaging block forming a receiving hole and a tongue thereof;

at least an adjusting apparatus assembled to the engaging blocks, and each adjusting apparatus including:

a base having a first base wall, and a second base wall and a third base wall substantially perpendicularly depending from opposite edges of the first base wall, a first assembling post is formed on an inner of the first base wall and adjacent to an edge thereof for engaging with the receiving hole and defining fastener holes therein, an axis hole being defined through the second base wall and the third base wall, a fixing axis pivotably received in the axis hole, and forming a pressure arm substantially on a side thereof for pressuring the tongue of the engaging block and a stop arm on the other side thereof, and a cover assembled with the base for enveloping the engaging block, and having a first cover wall, and a second cover wall and a third cover wall substantially perpendicularly depending from opposite edges of the first cover wall, the first cover wall forming a resilient button thereon for pressing the pressure arm and a second assembling post is formed on an inner side of the first cover wall and adjacent to an edge thereof for engaging with the receiving hole from on another side; and a head strap movably received in the fastener holes of the bases, and defining a plurality of stop slots for engaging with the stop arms;

after assembled, the pressure arm abuts the tongue and makes the stop arms engage with the stopping slots of the head strap such that the head strap is allowed to move in a single direction, when the resilient button is pressed the stop arms disengage from the stopping slots of the head strap such that the head strap is allowed to move in both directions when the operating buttons are pressed.

2. The swimming goggles as claimed in claim 1, wherein the left frame and the right frame respectively form engaging surfaces on outward sides thereof, the engaging blocks unitarily and outwardly extending from parts of the engaging surfaces, and wherein the engaging blocks are solid.

3. The swimming goggles as claimed in claim 2, wherein the engaging blocks further define L-shaped grooves at corners adjacent to the engaging surfaces.

4. The swimming goggles as claimed in claim 3, wherein the receiving hole is disposed through a center of the engaging block.

5. The swimming goggles as claimed in claim 4, wherein the tongue is disposed on the lower portion of the engaging block.

6. The swimming goggles as claimed in claim 1, wherein the second base wall and the third base wall respectively define at least a groove in inward sides thereof, and wherein the second cover wall and the third cover wall respectively form at least a latch at inward sides thereof for latching with the grooves.

7. The swimming goggles as claimed in claim 1, wherein the pressure arm has an arcuate side for pressuring the tongue, and a flat side for abutting the resilient button.

8. The swimming goggles as claimed in claim 1, wherein each stop arm has an inclined end for abutting the stop slot of the head strap.

9. The swimming goggles as claimed in claim 3, further comprising L-shaped locking ribs formed respectively on the bases and the covers and corresponding to the L-shaped grooves for further retaining the bases and the covers together.

10. The swimming goggles as claimed in claim 1, wherein the resilient buttons project integrally and outwardly from the first cover walls of the covers.

11. The swimming goggles as claimed in claim 10, wherein a plurality of inclined projections are formed on outward surfaces of the resilient buttons for enhancing friction.

12. The swimming goggles as claimed in claim 1, wherein the nose support is integrated with the left frame and the right frame.

13. The swimming goggles as claimed in claim 1, wherein soft pads are unitarily formed with the inner surfaces of the left frame and the right frame.

14. The swimming goggles as claimed in claim 1, wherein the pressure arm is further assembled with pressing the tongue of the engaging block to move it downwardly and has reserved energy therein.

* * * * *